United States Patent [19]

Scourtes

[11] 4,213,210

[45] Jul. 22, 1980

[54] AIR CHANNEL DEVICE

[75] Inventor: Chris N. Scourtes, Westland, Mich.

[73] Assignee: Aqua Star Pool Company, Westland, Mich.

[21] Appl. No.: 40,814

[22] Filed: May 21, 1979

[51] Int. Cl.[3] ..... A47K 3/00; A61H 33/02

[52] U.S. Cl. ..... 4/543; 4/583; 4/590; 128/369

[58] Field of Search ..... 4/1, 180, 178, 172

[56] References Cited

U.S. PATENT DOCUMENTS

| | | | |
|---|---|---|---|
| 743,025 | 11/1903 | Von Orth | 4/180 X |
| 2,848,203 | 8/1958 | Misiura | 4/180 |
| 2,921,579 | 1/1960 | Munroe | 4/180 X |
| 3,076,976 | 2/1963 | Bogar | 4/180 |
| 3,178,730 | 4/1965 | Bogar | 4/180 |
| 3,251,071 | 5/1966 | Wood | 4/180 |
| 3,299,885 | 1/1967 | Wessel | 4/180 X |
| 4,101,988 | 7/1978 | Sierant | 4/180 X |

*Primary Examiner*—Henry K. Artis

*Attorney, Agent, or Firm*—Cullen, Sloman, Cantor, Grauer, Scott & Rutherford

[57] ABSTRACT

An air channel device is disclosed for spas or bath units which is mat-like and has a plurality of openings therein to permit the entry of air into a heated bath. The air channel mat is mounted to the interior of the spa bath unit at any desired location including the foot and seat areas. It is secured to the interior surface of the spa by interlocking retainers which seal the periphery of the air channel to the interior of the spa. Air is blown into the spa beneath the air channel mat and then escapes into the bath through the perforations in the mat. The air channel device of the present invention eliminates prior U-shaped exterior air channels which were susceptible to cracking and breakage. The present air channel provides a cushioning effect in the foot and seat areas and also permits uniform aeration for the heated bath.

3 Claims, 6 Drawing Figures

FIG. 1
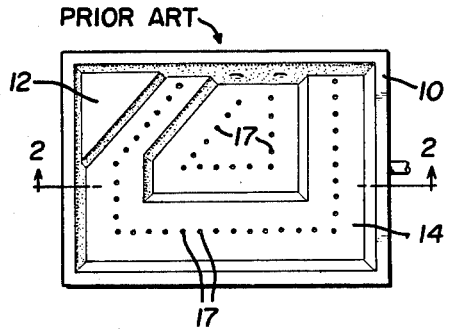
FIG. 2
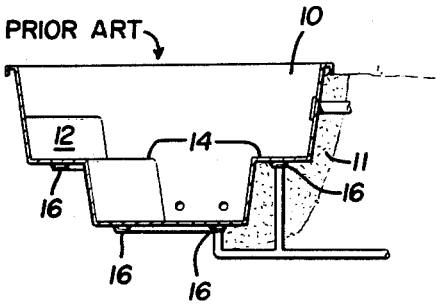
FIG. 6
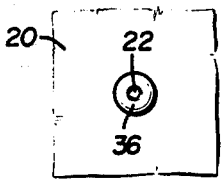
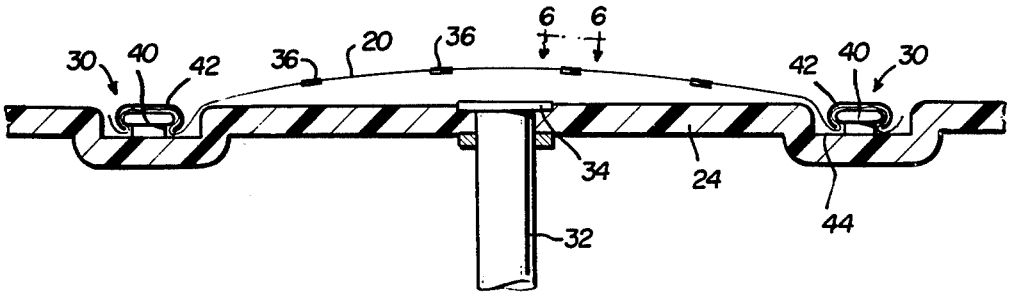
FIG. 5

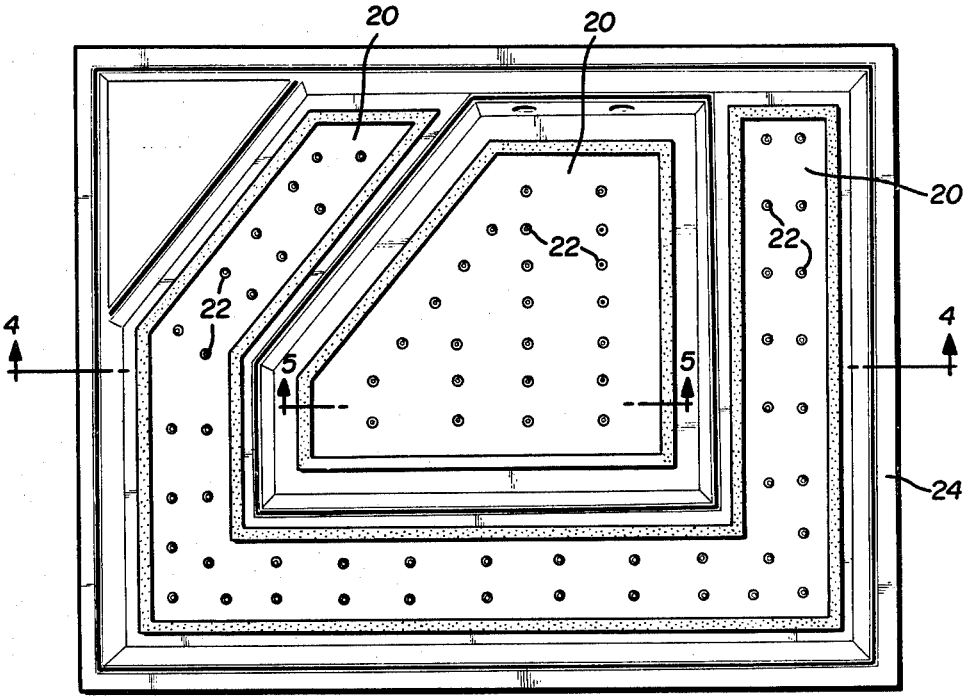
FIG. 3
FIG. 4
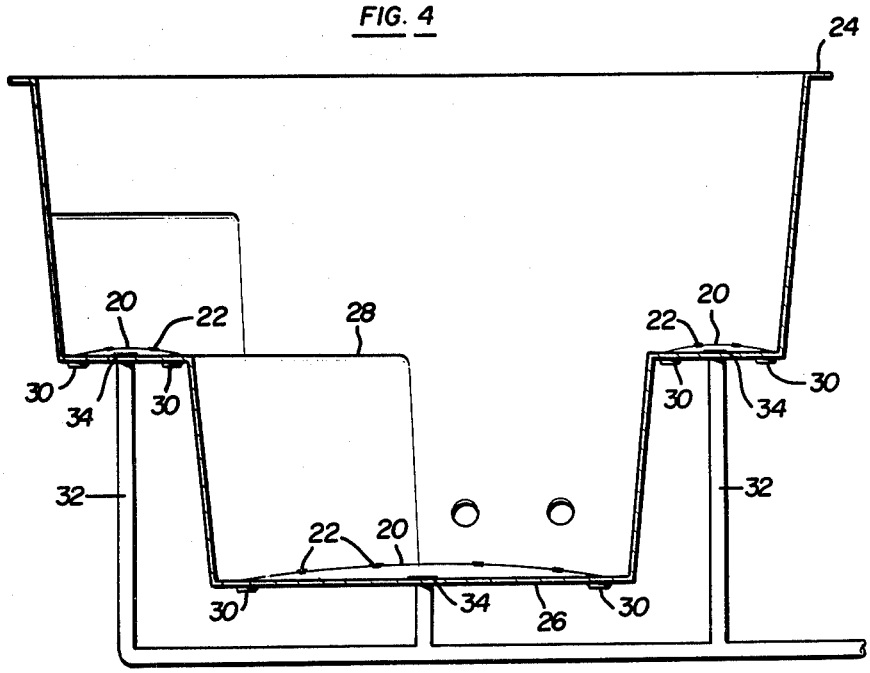

AIR CHANNEL DEVICE

BACKGROUND OF THE INVENTION

The present invention relates to home health spas or bath units and more particularly to an improved air channel in the form of a mat having a plurality of perforations therein to permit the entry of air into the heated bath.

Typical home spa constructions include a pre-fabricated bath unit filled with heated water which is circulated and aerated to provide therapeutic action to the user. The pre-fabricated bath unit is made of fiberglass and resin with a gel coat interior. It is set into an opening in a deck or the like and fill material such as sand is compacted around its exterior for support. It includes steps and seating areas so that the user may enter and depart from the bath and sit in the warm circulating water to reduce tension, improve circulation, and soothe aching muscles.

Air is blown into the spa bath unit through openings in its underside to bubble up through and agitate the warm water. Prior art constructions include U-shaped air channels which are fabricated separately and are glued or sealed onto the exterior surface of the bath unit base. An air blower is connected to the U-shaped air channels for pumping air through them and into the bath. Openings in the bath unit base are confined to the areas covered by the U-shaped air channels to permit air which is blown through the air channels to pass into and up through the bath.

The problem with the prior art air channels is that the seal between them and the bath unit is susceptible to breakage during installation or cracking when it freezes. The installer may break or damage an air channel during installation because they protrude from the bottom of the bath unit. When the spa is drained for the winter, not all of the water can be removed, and it freezes thereby causing the air channel to crack. Thus, there has been a need for an improved air channel to eliminate the problems attendant with the use of the prior U-shaped air channels.

Another disadvantage of existing air channels is that the air openings into the bath unit can only be placed within the relatively small confines of the U-shaped channel. Thus, it is difficult to provide uniform aeration in the bath.

The existing U-shaped air channels require an additional manufacturing step. They are fabricated separately from the bath unit, and then, they must be attached to the bath unit which requires additional labor, time and materials.

These and other disadvantages of present spa constructions have resulted in the improved air channel of the present invention.

SUMMARY OF THE INVENTION

The improved air channel device of the present invention is intended to be mounted to the interior of the spa bath unit such that the prior problems of leaking and freezing are eliminated.

The preferred embodiment of the present air channel device includes a mat-like construction having a plurality of perforations therein to permit the entry of air into the heated bath. The air channel mat is connected to the inside of the spa bath at any desired location including the foot and seat areas.

The air channel mat is preferably made of vinyl, polypropylene, or other suitable flexible materials, and it is secured to the interior surfaces of the bath unit by unique interlocking retainers which secure and seal the periphery of the mat to the interior of the spa.

Air is blown into the spa beneath the air channel mat and then escapes into the bath through perforations in the mat which are reinforced by plastic or metal eyelets. Thus, the air channel device of the present invention only requires an air conduit be connected between the air blower and spa which eliminates the prior U-shaped air channels which were susceptible to cracking and breakage.

The unique retainers for securing the air channel mat to the spa include a bottom retainer portion and top snap portion. A groove is made in the spa around the periphery of the air channel mat. The bottom retainer portion is bonded into the groove by a suitable mastic material, and the mat is stretched across the bottom retainer. The top retainer portion is snapped into the bottom portion with the mat interposed therebetween. The periphery of the air channel mat is thereby sealed and secured against the spa. The groove is of a depth that permits the retainer and attached mat periphery to be flush with the bottom of the spa.

There are many advantages to the air channel mat of the present invention. It eliminates the additional manufacturing step required for making the conventional U-shaped air channel and also reduces the possibility of leakage and damage from freezing.

The present air channel provides a cushioning effect in the foot and seat areas because air is compressed between it and the spa surface. The mat is raised slightly above the spa surface by the incoming air, and this provides the user with a feeling that the foot and seat areas are cushioned.

The new air channel device also provides for uniform aeration in the heated bath. Perforations may be made in the air channel mat at any desired location whereas with the conventional U-shaped air channels, the perforations were confined to the small area covered by the U-shaped air channels secured to the spa.

Other advantages and meritorious features of the air channel device of the present invention will be more fully understood from the following description of the preferred embodiment, the appended claims, and the drawings, a brief description of which follows.

BRIEF DESCRIPTION OF DRAWINGS

FIG. 1 is a top plan view of a prior art spa or bath unit having conventional U-shaped air channels secured thereto;

FIG. 2 is a cross-sectional view taken along line 2—2 in FIG. 1 illustrating the conventional U-shaped air channels of the prior art;

FIG. 3 is a top plan view of a spa bath unit having the air channel device of the present invention;

FIG. 4 is a cross-sectional view taken along line 4—4 in FIG. 3 illustrating the air channel mat of the present invention;

FIG. 5 is a cross-sectional view taken along line 5—5 in FIG. 3 illustrating the interlocking retainers for securing the air channel device to the spa unit; and FIG. 6 is a cross-sectional view taken along 6—6 in FIG. 5 illustrating the reinforcing eyelets for the perforations in the air channel mat.

DESCRIPTION OF THE PREFERRED EMBODIMENT

The disadvantages of prior art spa constructions are illustrated in FIGS. 1–2. A pre-fabricated bath unit 10 is filled with heated water which is circulated and aerated to provide therapeutic action to the user. It is set into an opening in a deck or the like and fill material such a sand 11 is compacted against its exterior for support.

The spa unit 10 includes a step 12 and seating area 14 so that the user may enter and depart from the bath and sit in the warm circulating water. Air is blown through U-shaped air channels 16 and then into the spa water through openings 17 in the underside of the bath unit 10.

The prior art U-shaped air channels 16 are fabricated separately and glued or sealed onto the exterior of the bath unit. Air openings 17 in the bath unit are confined to the small areas covered by the U-shaped air channels. These prior art air channels 16 are susceptible to breakage during installation or cracking from freezing. These and other disadvantages have been overcome by the improved air channel device of the present invention.

The air channel device 20 of the present invention is illustrated in FIGS. 3–6. It is intended to be mounted to the interior of the spa bath unit to eliminate the prior problems of leaking and damage due to freezing.

The air channel 20 of the present invention is a mat-like construction having a plurality of perforations 22 therein to permit the entry of air into the heated bath. The air channel mats are mounted to the inside of spa bath 24 at any desired location including the foot and seat areas 26 and 28 as illustrated.

The air channel 20 is preferably made of vinyl, polypropylene, or other suitable materials, and it is secured to the interior surfaces of spa 24 by unique interlocking retainers 30 which secure and seal the periphery of the mat to the interior of the spa.

Air is blown into the spa beneath the air channel mats 20 through air conduits 32 which are coupled and sealed to the spa base by coupling assemblies 34. The air escapes into and bubbles through the bath water through perforations 22 which are reinforced by plastic or metal eyelets 36 as illustrated in FIG. 6. Thus, the air channel 20 of the present invention permits the air conduit 32 to be directly connected between an air blower (not shown) and the spa which eliminates the prior U-shaped air channels.

The retainers 30 for securing the air channel mat to the spa include a bottom retainer portion 40 and a top snap portion 42. A groove is cut in the interior spa surface around the periphery of the air channel mat. The bottom retainer portion 40 is bonded into the groove by a suitable mastic material and the mat 20 is stretched across the bottom retainer. The top retainer portion 42 is snapped into the bottom portion with the mat interposed therebetween thereby sealing the periphery of the air channel mat. The groove 44 is of a depth that permits the retainer and attached mat periphery to be flush with the bottom of the spa.

There are several advantages to the air channel mat of the present invention. It eliminates the usual exterior fabricated U-shaped air channel. It provides a cushioning effect in the foot and seat areas because air is compressed between the spa surface and mat. The present air channel device also provides for uniform aeration of the heated bath because perforations may be made in the mat at any desired location whereas with the exterior U-shaped air channels, the perforations were confined to the area covered by the channels.

It will be apparent to those skilled in the art that the foregoing disclosure is exemplary in nature rather than limiting, the invention being limited only by the appended claims.

I claim:

1. In a bath unit which includes a base, said base having at least one interior surface formed therein on which a user may sit or rest his feet, the improvement comprising:

a flexible mat mounted on said interior surface, said mat having a plurality of perforations therein to permit the entry of air into a liquid in said base for aerating said liquid;

said mat mounted on said interior surface by retainer means, said retainer means securing the periphery of said mat to said interior surface, said retainer means including a bottom retainer portion and a top snap portion, said bottom retainer portion integrally mounted to said interior surface around the periphery of said mat, said mat stretched across said bottom retainer portion, and said top snap portion fitted onto said bottom retainer portion with said mat interposed therebetween thereby sealing the periphery of said mat to said interior surface; and means for blowing air into said bath unit through a sealed opening in said interior surface, said sealed opening being beneath said mat, said air escaping into said liquid through said perforations in said mat, and said interior surface of said bath unit and said mat forming an air channel for providing a cushioning effect to said user due to the air which is compressed between said mat and said interior surface.

2. The bath unit as defined in claim 1 wherein said bottom retainer portion being mounted within a groove in said interior surface, said groove extending around the periphery of said mat, said groove being of a depth for permitting the periphery of said mat to be flush with the top of said interior surface.

3. The bath unit as defined in claim 1 wherein said perforations in said mat are reinforced by eyelet means.

* * * * *